US007537333B2

(12) United States Patent
Kessler et al.

(10) Patent No.: US 7,537,333 B2
(45) Date of Patent: May 26, 2009

(54) LOW FRICTION REDUCED FIBER SHED DRUM MAINTENANCE FILTER AND RECLAMATION METHOD

(75) Inventors: Kelly A. Kessler, Wilsonville, OR (US); Joseph B. Gault, Portland, OR (US); Abu S. Islam, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 600 days.

(21) Appl. No.: 11/148,415

(22) Filed: Jun. 9, 2005

(65) Prior Publication Data

US 2006/0279620 A1 Dec. 14, 2006

(51) Int. Cl.
*B41J 2/175* (2006.01)
*B41J 2/01* (2006.01)

(52) U.S. Cl. ..... 347/103; 347/93

(58) Field of Classification Search ..... 347/103, 347/93, 84, 101
See application file for complete search history.

(56) References Cited

U.S. PATENT DOCUMENTS 3,844,865 A * 10/1974 Elton et al. ..... 156/229
4,293,866 A * 10/1981 Takita et al. ..... 347/103
4,296,884 A * 10/1981 Luebke ..... 238/2
4,538,156 A 8/1985 Durkee et al.
4,965,900 A * 10/1990 Smith ..... 5/695
5,205,938 A * 4/1993 Fiumano et al. ..... 210/653
5,277,520 A * 1/1994 Travis ..... 405/129.6
5,389,958 A 2/1995 Bui et al.
5,505,863 A * 4/1996 Danon et al. ..... 210/774
5,800,586 A * 9/1998 Cusick et al. ..... 55/486
5,808,645 A 9/1998 Reeves et al.
6,068,372 A 5/2000 Rousseau et al.
6,431,703 B2 * 8/2002 Rousseau et al. ..... 347/103
6,652,083 B2 * 11/2003 Ison et al. ..... 347/93
6,921,064 B2 * 7/2005 Rousseau ..... 267/36.1
7,036,920 B2 * 5/2006 Rousseau et al. ..... 347/103
7,048,369 B2 * 5/2006 Rousseau et al. ..... 347/103
2002/0119299 A1 * 8/2002 Chen et al. ..... 428/311.51

FOREIGN PATENT DOCUMENTS

DE 10027751 A1 * 1/2002

OTHER PUBLICATIONS

U.S. Appl. No. 10/740,461, filed Dec. 22, 2003, Rousseau et al.

* cited by examiner

*Primary Examiner*—Stephen D Meier
*Assistant Examiner*—Leonard S Liang
(74) *Attorney, Agent, or Firm*—Oliff & Berridge, PLC

(57) ABSTRACT

A system for applying a liquid to a support surface in an imaging apparatus comprises an application surface that applies liquid to the support surface; and a filter positioned in relation to the application surface such that liquid removed from the support surface passes through the filter to the application surface. The filter includes a low-friction, low-fiber shed permeable layer in contact with the application surface.

19 Claims, 8 Drawing Sheets

LOW FRICTION REDUCED FIBER SHED DRUM MAINTENANCE FILTER AND RECLAMATION METHOD

BACKGROUND

The present invention relates generally to an improved filter for a drum maintenance unit in an imaging system. More specifically, the invention relates to a reclamation system and process in an offset print imaging system that reclaims fluid and filters the fluid through a low friction, reduced fiber shed filter.

Offset ink jet printing systems having intermediate transfer surfaces are known. U.S. Pat. No. 4,538,156 to Durkee et al. discloses a system where an intermediate transfer drum is employed with a print head. A final receiving surface of paper is brought into contact with the intermediate transfer drum after the image has been placed on the intermediate drum by nozzles in the print head. The image is then transferred to the final receiving surface. A cleaning medium is then brought into contact with the intermediate transfer drum to prepare the surface of the drum prior to the next image being formed on the transfer surface.

U.S. Pat. No. 5,389,958 to Bui et al. discloses an offset ink jet printing system in which a liquid intermediate transfer surface is applied to the transfer drum. Nozzles in the print head then eject drops of ink onto the liquid intermediate transfer surface to form an ink image thereon. A final receiving substrate such as paper is then brought into contact with the intermediate transfer surface, and the ink image is transferred to the final receiving substrate. The liquid intermediate transfer surface is cleaned and reapplied prior to the next image being formed on the transfer surface.

Ink jet printing systems that use a liquid intermediate transfer surface generally require an applicator to apply the desired amount of liquid onto the intermediate transfer support surface. One such applicator of this type is disclosed in U.S. Pat. No. 5,808,645 to Reeves et al. This patent discloses an applicator that is housed in a replaceable transfer drum maintenance cassette.

U.S. Pat. No. 6,068,372 to Rousseau et al. also discloses a replaceable liquid application system for applying a liquid intermediate transfer surface to a support surface in a printer. The liquid application system is contained in a removable cassette and uses a liquid impregnated arcuate surface that engages the support surface by rolling contact. The liquid impregnated arcuate surface is contained in a removable cartridge in the cassette.

In the 372 patent, the cartridge also contains a reclamation assembly that extends the useful life of the cartridge. The reclamation assembly reclaims liquid from the support surface, filters the liquid by passing the liquid over a filter, and supplies the liquid back to the arcuate surface for reapplication to the support surface. Over time, however, the filter may become clogged with debris. Once clogged, the system will operate as if the filter did not exist. This will allow debris to reach the roller and cause problems.

Another replaceable liquid application system for applying a liquid intermediate transfer surface to a support surface in a printer is disclosed in co-pending U.S. patent application Ser. No. 10/740,461 filed Dec. 23, 2003. Like the 372 patent, the liquid application system is contained in a removable cassette and uses a liquid impregnated arcuate surface that engages the support surface by rolling contact. This system also includes a reclamation assembly that reclaims liquid from the support surface, filters the liquid by passing the liquid over a filter, and supplies the liquid back to the arcuate surface for reapplication to the support surface. The filter is a polyester felt and the transfer roller is of a polyurethane foam.

SUMMARY OF THE INVENTION

The above reclamation systems work well when used with their corresponding urethane drum maintenance unit rollers. Friction from the direct contact with the felt was not considered a problem because of the relatively low frictional coefficient of the roller. Also, there was only minimal shedding of felt fibers from the contact.

However, recently, new drum maintenance rollers have been developed. These rollers have a higher coefficient of friction than the prior polyurethane foam filter. Existing felt filters were found to be inadequate for use with these rollers and experienced problems with excessive shedding and friction. This is because the prior felt filters were formed from a material having short fibers attached to one another by tangling. The filter released fibers by untangling of the short fibers when subjected to loads.

In particular, a drum maintenance unit operates by filtering and reclaiming a liquid, such as oil, and returning it back to the roller. The reclaimed and clean oil is transferred from the filter to the roller through contact pressure. This contact pressure causes friction between the roller and the filter. With different roller materials, this friction could sometimes exceed the driving force of the drum on the roller, inhibiting free rotation of the roller. Additionally, with this extra friction, shedding of filter fibers could become excessive, resulting in a lower life expectancy of the unit due to excess loose fibers contaminating the oil, or contaminating other areas in the printer (specifically the printhead), or from the filter being destroyed by the excessive shedding.

The disclosure is directed to an improved filter design in a drum maintenance unit that applies a liquid to a support surface in an imaging apparatus. This support surface may be the surface of an intermediate transfer drum. The system comprises an application surface that applies liquid to the support surface and a filter positioned in relation to the application surface such that liquid removed from the support surface passes through the filter to the application surface.

In exemplary embodiments, the drum maintenance unit filter separates the liquid, such as oil, from the debris collected by the drum maintenance unit and returns clean oil to the roller. The oil is transferred from the filter through contact pressure.

In exemplary embodiments, the filter is a porous, open-cell filter material. In exemplary embodiments, the filter is formed of a non-woven textile, preferably a polyester felt.

According to aspects illustrated herein, the filter includes a liner of permeable polyester.

In various exemplary embodiments, the liner is affixed to the base filter material through adhesive or coating. In a preferred embodiment, the liner and filter are formed as separate layers. Pressure-sensitive adhesive dots are spaced on the filter and the liner is pressed against the filter to bond the two layers together, resulting in an oil permeable composite filter.

In certain embodiments, the liner is composed of long fibers bonded to one another to form a continuous web. The long fibers and thermal bond serve to reduce the amount of material released under load.

In various exemplary embodiments, the roller is formed of an absorbent material. A suitable roller is a woven polyester/nylon blend material. Although this material has a higher coefficient of friction than prior polyurethane foam rollers, the lined filter enables the roller to freely rotate, even with direct contact of the filter on the roller. However, the lined filter is also compatible with the previously used polyurethane foam rollers described in the 372 patent.

In exemplary embodiments, a capillary property of such a filter and liner drives oil through the filter to the application surface, leaving any solid particles, such as ink or paper dust, trapped in the filter.

In exemplary embodiments, the application surface and filter are in a cartridge that can be removed and replaced to increase the useful life of the imaging device.

In certain embodiments, the system further comprises a metering blade for distributing the liquid on the support surface. In the process of distributing liquid on the support surface, some liquid from the support surface may be removed from the support surface. In preferred embodiments of the invention, this liquid then passes through the filter to the application surface in order to be reused.

In embodiments in which the system includes a metering blade, the metering blade may, but need not, be in a cartridge that also contains an application surface and a filter. The metering blade may be attached to such a cartridge or to another part of the imaging device by an elongated blade mounting bracket.

In other certain embodiments, there may be a physical barrier adjacent the application surface that directs liquid removed from the support surface to the filter. This physical barrier blocks the ability of the liquid removed from the support surface by, for example, the metering blade, from coming into contact with the application surface before it goes through the filter. This physical barrier may also provide structural support for the filter. In particular, the filter may be attached to this physical barrier.

In a preferred embodiment, a system is provided for applying a liquid to a support surface in an imaging apparatus and reclaiming part of the liquid. The system includes: a roller surface that applies liquid to the support surface; and a liquid permeable filter having a back filtration surface and a front filtration surface on which a low friction liner surface is affixed thereto, the liner surface being in direct frictional contact with the roller surface. The filter receives liquid reclaimed from the support surface on the back filtration surface and passes clean liquid through the front filtration surface past the liner surface and to the roller surface.

In certain embodiments, the system can be part of an imaging device. Specifically, an imaging device may include a support surface, a roller surface that applies liquid to the support surface to form an intermediate liquid transfer surface on the support surface, a permeable, low friction filter positioned in relation to the roller surface such that liquid removed from the support surface passes through the filter to the application surface, and a printhead that applies ink on the intermediate liquid transfer surface on the support surface. In preferred embodiments, this imaging device is a phase change, offset ink jet printer. In addition, in embodiments, the support surface of this imaging device is the surface of a transfer drum rotatably mounted in the imaging device.

The disclosure also relates to a method for reclamation of liquid in an imaging device. The method comprises bringing an application surface into contact with the support surface to apply liquid from the application surface to the support surface; metering the liquid on the support surface, and reclaiming part of the liquid from the support surface; and passing reclaimed liquid removed from the support surface through a filter to the application surface for reapplication to the support surface, wherein the filter includes a low friction, permeable liner layer that contacts the support surface to enable free rotation of the roller.

These and other features and advantages are described in, or are apparent from, the following detailed description of various exemplary embodiments.

BRIEF DESCRIPTION OF THE DRAWINGS

Various exemplary embodiments of the systems and methods of this invention are described in detail below, with reference to the attached drawing figures, in which.

DETAILED DESCRIPTION OF EXEMPLARY EMBODIMENTS

Reference will now be made in detail to an exemplary embodiment of the invention as illustrated in the accompanying drawings. In this exemplary embodiment, the ink printing apparatus is a phase change, offset ink printing apparatus.

Figure 1:
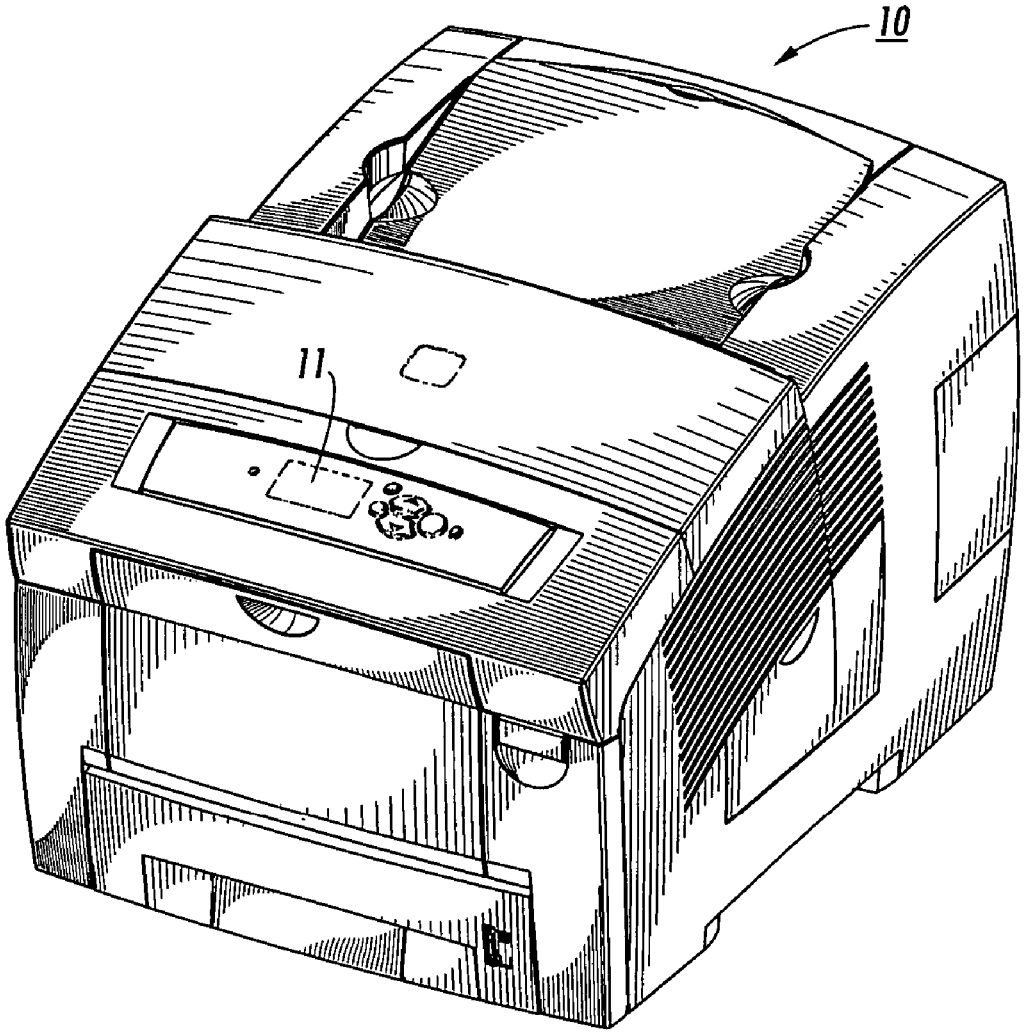
FIG. 1 is an overall perspective view of an exemplary phase change ink offset printer that uses a liquid application system incorporating a drum maintenance unit.

FIG. 1 is an overall illustration of a phase change, offset ink printing apparatus, generally indicated by the reference numeral 10, which uses a liquid application system. Printing apparatus 10 may include a display panel 11. As referenced above, the liquid application system may be used to apply a liquid intermediate transfer surface to an intermediate transfer support surface in an offset printing apparatus. Examples of solid ink or phase change ink offset imaging technology is disclosed in U.S. Pat. No. 5,389,958 to Bui et al., U.S. Pat. No. 5,808,645 to Reeves et al., U.S. Pat. No. 6,068,372 to Rousseau et al., and U.S. patent application Ser. No. 10/740,461, each of which are hereby specifically incorporated by reference herein in their entirety.

The following description of an exemplary embodiment of the liquid application system refers to its use in the type of phase change ink offset printing apparatus described in these three patents and application. It will be appreciated, however, that the application system may be used with various other imaging and printing apparatus that use different imaging technologies and/or architectures and require the application of a liquid. Accordingly, the following description will be regarded as merely illustrative of one embodiment of the disclosure.

Figure 2:
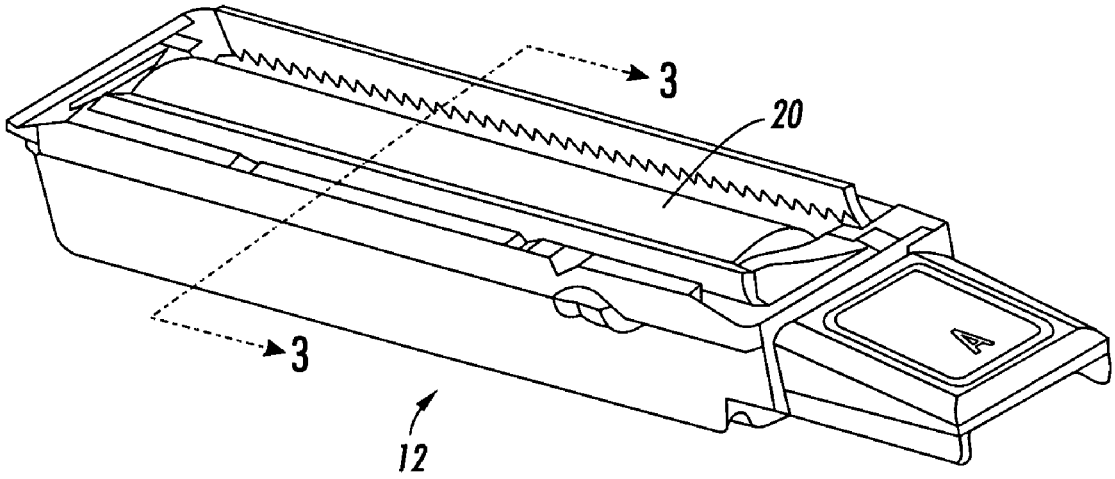
FIG. 2 is a perspective view of an exemplary replaceable cartridge that is inserted into the printer of FIG. 1 and may contain the liquid application system of FIG. 1.

FIG. 2 illustrates a replaceable cartridge 12 that uses a liquid application system to apply a liquid intermediate transfer surface to a support surface in an offset inkjet printer. The removable cartridge, which may be referred to as a drum maintenance unit, contains a liquid impregnated roller 20 for applying the intermediate liquid transfer surface to the support surface in the printer 10. Preferably, the cartridge 12 is made from a low-cost structural material, such as plastic.

Figure 3:
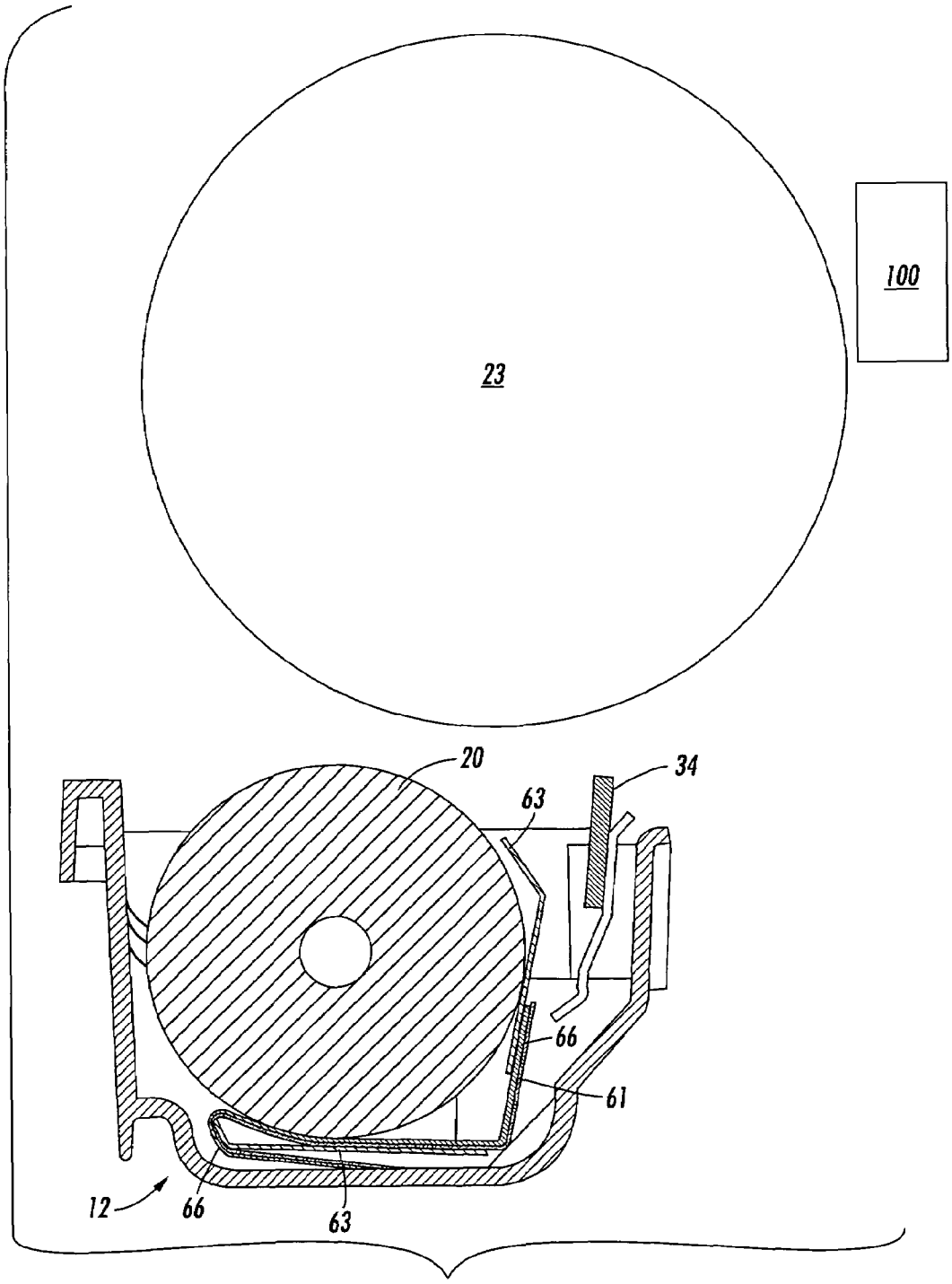
FIG. 3 is a side view of the cartridge taken along the section line 3-3 in FIG. 2 showing an exemplary embodiment of a liquid application system in a park position adjacent to the transfer drum in the printer.

FIG. 3 illustrates a sectional side view of an exemplary replaceable cartridge 12 in a first, "park" position. The cartridge 12 is shown positioned adjacent to the intermediate transfer support surface in the printer. The intermediate transfer support surface may take the form of a transfer drum 23 as shown in FIG. 3, or alternatively may be a belt, web, plate or other suitable design. The removable cartridge is generally indicated by the reference numeral 12 and includes a liquid impregnated roller 20. In the "park" position illustrated in FIG. 3, the liquid impregnated roller 20 and the blade 34 are not in contact with the transfer drum 23.

Figure 4:
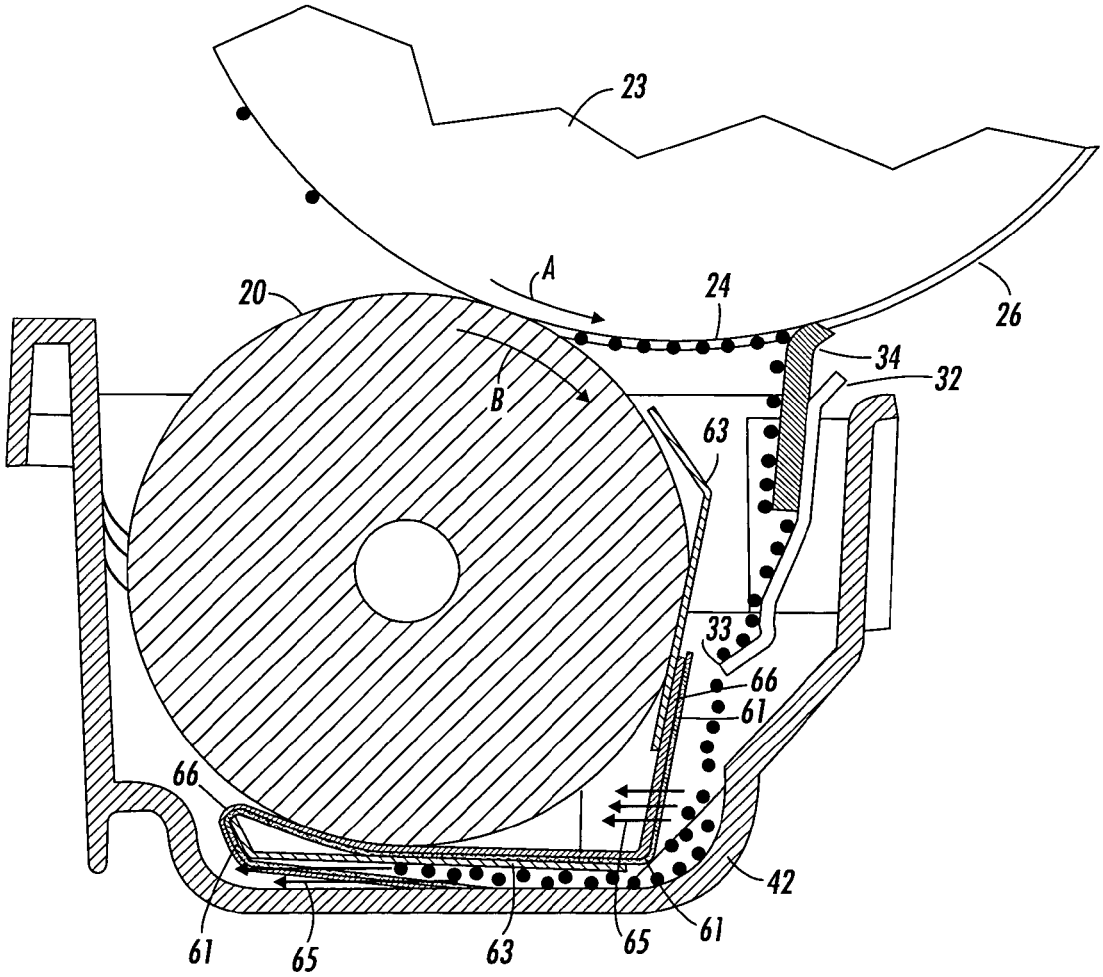
FIG. 4 is an enlarged partial side view showing an exemplary embodiment of liquid application system in which the roller and blade are elevated to an apply position in which the roller and blade engage the transfer drum and apply a liquid intermediate transfer surface to the drum.

With reference to FIG. 4, prior to imaging, the liquid impregnated roller 20 is raised to contact and apply a liquid intermediate transfer surface 26 to the surface 24 of the transfer drum 23. In embodiments, the roller 20 can be made of any suitable material. Preferably, roller 20 is formed from an absorbent material, such as a woven, polyester/nylon blend. However, roller 20 could also be an extruded polyurethane foam. The roller 20 is appropriately sized to apply a liquid transfer surface to a printer.

With continued reference to FIGS. 3-4, the cartridge 12 may also include a metering blade 34 that distributes the liquid intermediate transfer surface 26 across the surface 24 of the transfer drum 23 to consistently provide a uniform liquid layer on the drum surface. In exemplary embodiments, the blade 34 is comprised of an elastomeric material and is affixed to an elongated blade mounting bracket 32. As described above, the function of the liquid impregnated roller 20 and the elastomeric blade 34 is to apply a finely metered amount of liquid to the transfer drum surface 24.

In operation, the transfer drum 23 rotates in the direction of action arrow A as the liquid impregnated roller 20 and blade 34 are raised into contact with the transfer drum surface 24. The roller 20 is driven to rotate in the direction of action arrow B by frictional contact with the transfer drum surface 24 and applies the liquid intermediate transfer surface 26 to the drum surface 24. Advantageously, as the roller 20 rotates as it applies liquid to the drum surface 24, the point of contact on the roller 20 is continuously moving such that a fresh portion of the roller 20 is continuously contacting the drum surface to apply the liquid. As the liquid intermediate transfer surface 26 on the drum surface 24 reaches the blade 34, the blade 34 then meters the liquid to evenly distribute a uniform liquid layer across the drum surface 24.

Once the application of the liquid intermediate transfer surface 26 is complete, the print head 100 (FIG. 3) jets an ink image on top of this liquid surface. The ink image is then transferred and fused onto a final receiving medium, such as paper, by pressing the paper against the transfer drum 23 with a rotating pressure roller (not shown). The liquid intermediate transfer surface 26 acts as a sacrificial layer which can be at least partially transferred with the ink image to the final receiving medium. Suitable liquids that may be used as the liquid intermediate transfer surface 26 include water, fluorinated oils, glycol, surfactants, mineral oil, silicone oil, functional oils and combinations thereof. Functional oils can include, but are not limited to, mercapto-silicone oils, fluorinated silicone oils and the like. The liquid may be silicone oil, particularly amino silicone oil. The final print medium may be a transparency, paper or other suitable media.

With continued reference to FIG. 4, the blade 34 functions to meter the correct amount of liquid, such as oil, onto the drum surface 24 and to capture paper fibers, untransfixed pixels and other debris. The oil impregnated roller 20 applies enough oil to the drum surface 24 to maintain a constant puddle or "oil bar" in front of the blade 34 to insure that there is always a sufficient amount of oil available to be metered. In operation, the debris captured by the blade 34 becomes trapped in the oil bar and flows down the blade as described in more detail below. As the blade 34 meters the oil, the blade is lifted off the drum surface 24 to allow a metered portion of the oil to flow past the blade. By adjusting the contact force of the blade 34 against the drum surface 24 and the angle of attack of the blade, the desired amount of blade lift is established.

Figure 5:
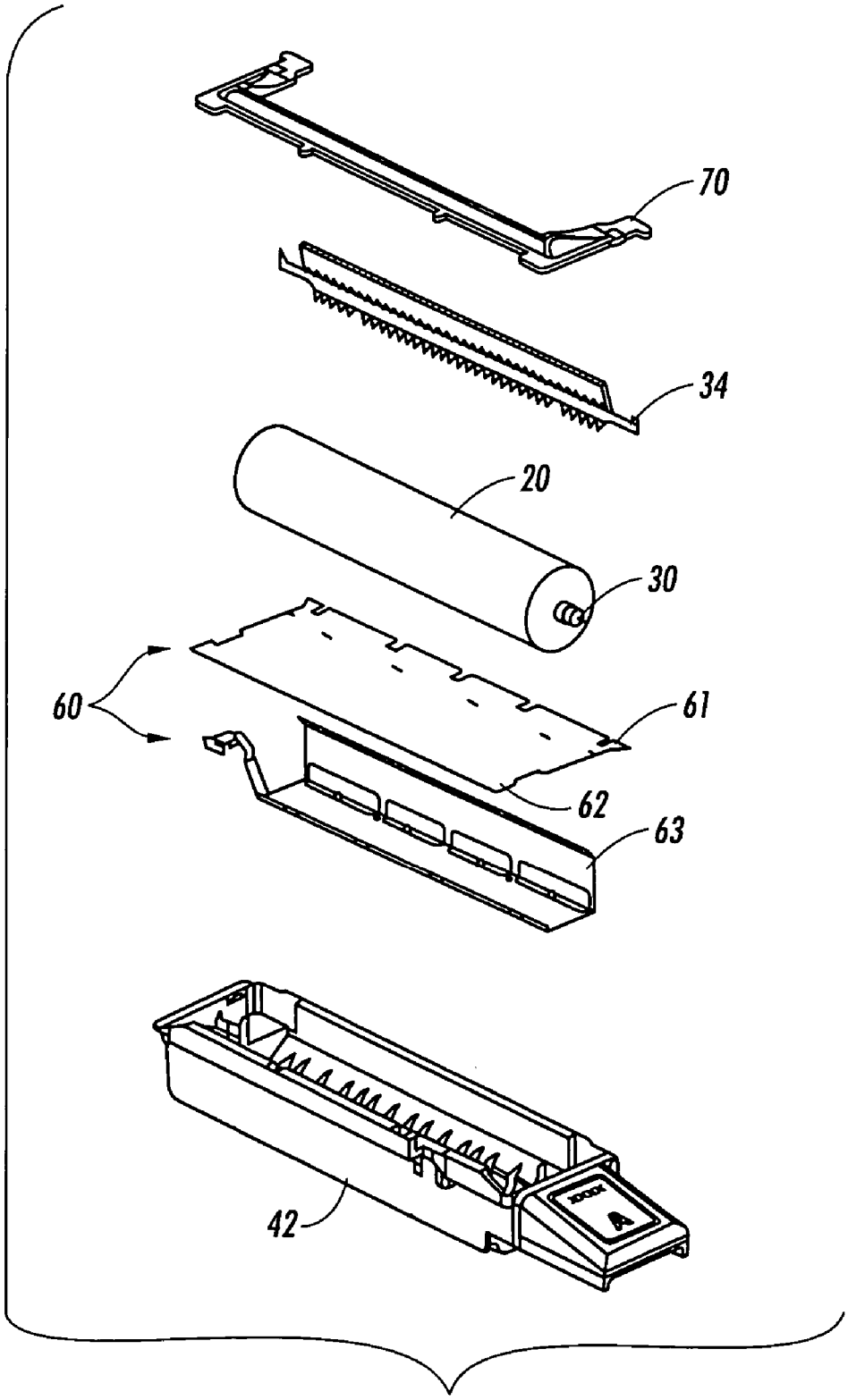
FIG. 5 is an exploded perspective view of the replaceable cartridge of FIG. 2, showing both the filter and the support of the exemplary reclamation assembly.

FIG. 5 is an exploded perspective view of the removable cartridge 12 in FIG. 2. As shown in FIG. 5, the removable cartridge 12 comprises an elongated housing 42. A shaft 30 extends from each end of the roller 20 and into apertures in the housing (not shown). Roller 20 is rotatably retained within the housing 42. The removable cartridge 12 may further include a cover 70.

As in the embodiment depicted in FIG. 5, the removable cartridge 12 may further include a metering blade 34. The metering blade 34 may, but need not, be in the cartridge.

With reference to FIGS. 3-6, the exemplary removable cartridge 12 also includes a reclamation assembly, generally designated by the reference numeral 60, that recycles reclaimed oil from the drum surface 24, filters debris from the oil and transfers the reclaimed oil to the roller 20 for reapplication to the drum surface. In embodiments, the reclamation assembly 60 includes a filter 61, which may be formed of a synthetic non-woven textile, such as a polyester felt. Filter 61 further includes a low friction, permeable liner 66 affixed to a front face of the filter by suitable coating, bonding, adhesion or the like.

Figure 6:
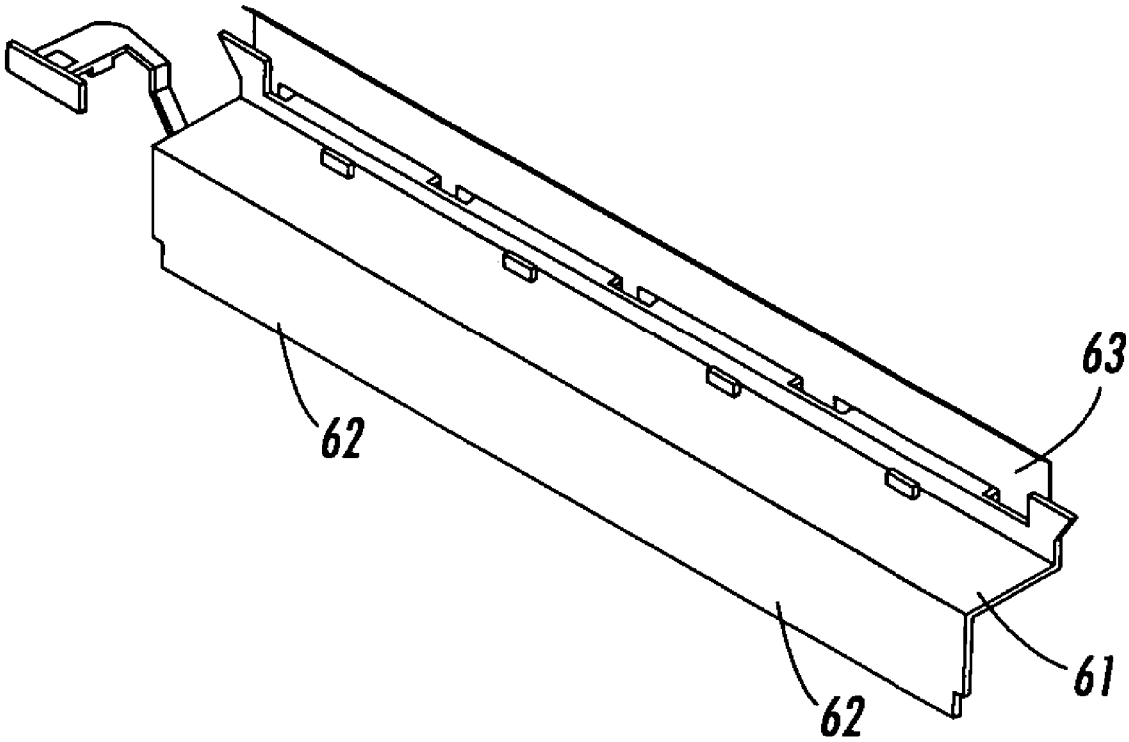
FIG. 6 is an enlarged perspective view of the filter and the support of the exemplary reclamation assembly, as fit together.

In embodiments, the reclamation assembly further includes a support 63 that holds the filter 61 into position. The support may be formed of any material that is impermeable to the liquid and provides sufficient structure to maintain the position of the filter 61. The support 63 may also provide a physical barrier between reclaimed liquid and the roller 20 before it is filtered. As depicted in FIGS. 5-6, the filter 61 fits through holes in the support 63. In addition, a liquid receiving portion 62, which preferably conforms to the interior of housing 42, may be folded beneath the support 63 as shown.

With reference to FIG. 4, in operation, excess oil from the liquid intermediate transfer surface 26 and debris trapped within the oil, such as paper fibers, untransfixed ink pixels and the like, flow down the blade 34 and blade mounting bracket 32 and drip into a lower portion of housing 42. The blade mounting bracket 32 may include multiple downwardly directed drip points 33 from which the excess oil and entrained debris drip. The drip points 33 extend across the length of the mounting bracket 32 to evenly distribute the excess oil to the filter 61.

As the excess or reclaimed oil and entrained debris drips down into housing 42, it begins to flow though the filter 61. As the oil flows through the filter 61, the polyester fibers thereof filter the oil by trapping and retaining debris while simultaneously allowing the oil to flow though the filter to the other side of the filter where it comes into contact with the roller 20. By making the liner 66 liquid permeable, flow of oil through the filter 61 is not substantially inhibited. The oil has two paths, which are each depicted by a set of arrows 65 in FIG. 4. In this manner, the reclaimed oil that is transferred back to the roller 20 has been filtered to remove the debris captured by the blade 34 and the filtered debris accumulates in the filter 61 away from contact with the roller 20. Additionally, by recycling the reclaimed oil back into the roller 20, the reclamation assembly significantly increases the useable life of the roller 20 and thus the removable cartridge 12.

Figure 7:
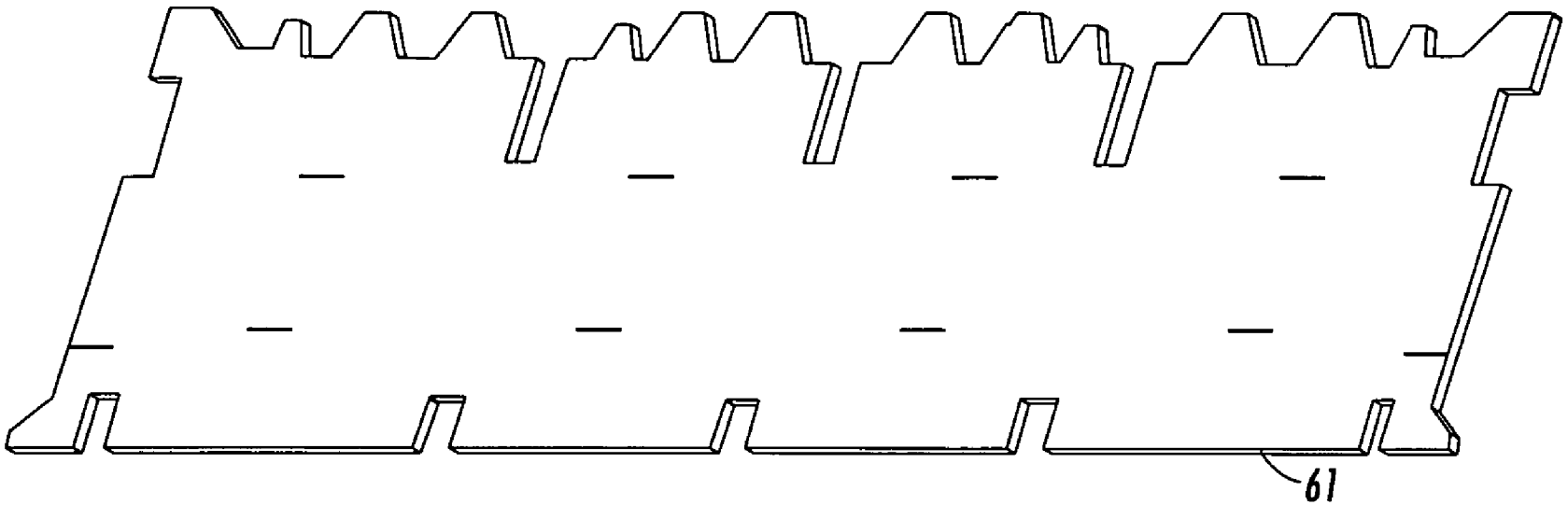
FIG. 7 (PRIOR ART)
FIG. 7 is an enlarged perspective view of a conventional reclamation assembly filter.
Figure 8:
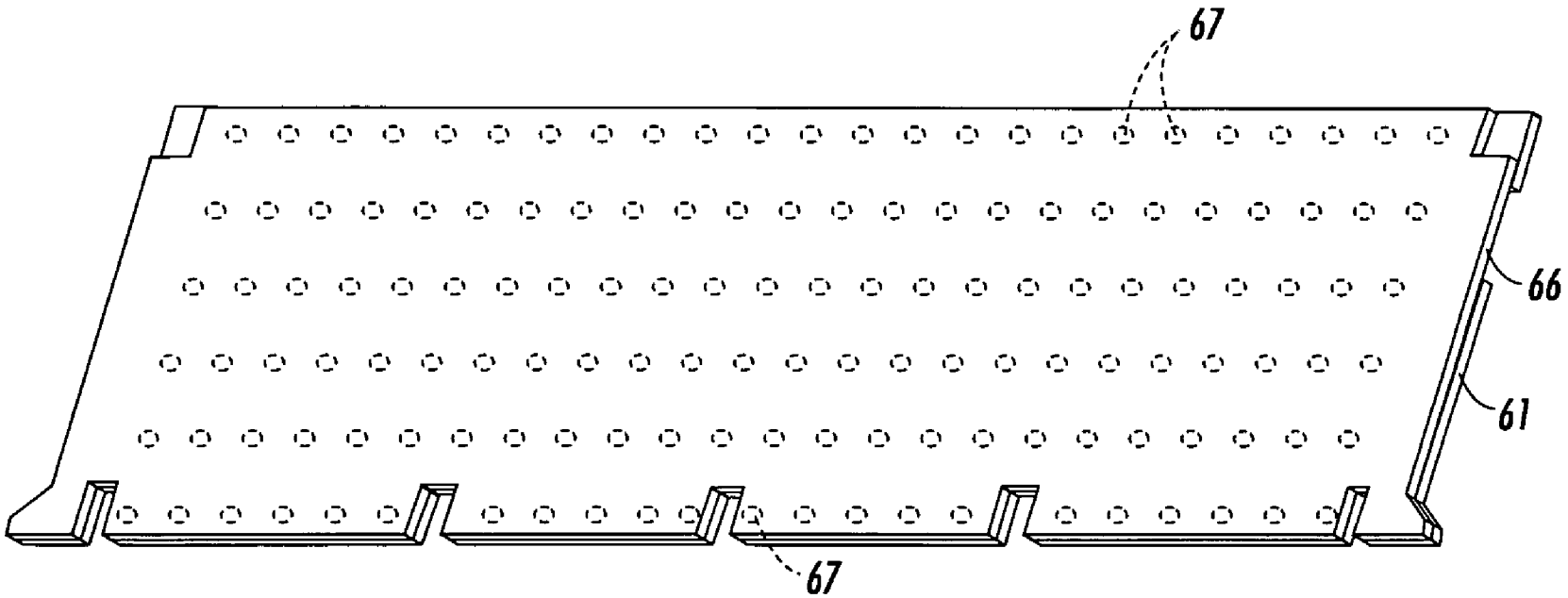
FIG. 8 is an enlarged perspective view of an exemplary reclamation assembly filter and liner.

Additional details of the filter 61 will be described with reference to FIGS. 7-8. FIG. 7 shows a prior filter design in which a filter 61 consisted of a polyester felt layer that directly contacted the drum maintenance unit roller. The prior filter was composed of short fibers attached to one another by tangling, and experiences shedding. FIG. 8 shows a new filter design in which filter 61 includes a liner layer 66 on the front side that has low-a shed feature.

In a preferred embodiment, liner 66 encompasses the entire front face of filter 61. However, it is only necessary that contact regions on the front face be covered with the liner 66. Thus, referring back to FIGS. 3-4, only those regions of filter 61 that may come into contact with roller 20 require the liner 66.

Liner 66 can be affixed to felt filter 61 through various methods. A preferred method provides a separate felt filter layer 61 and polyester liner layer 66. A series of spaced, small pressure-sensitive adhesive dots 67 are provided on the front face of felt filter 61. The dots 67, preferably about 2 mm in diameter, are provided along the entire front face, or at least at peripheral edges of felt filter 61. The liner 66 is then placed over the filter layer and pressed into place. Any suitable adhesive for dots 67 that is capable of bonding with or adhering to the two materials can be used. However, the adhesive needs to be impervious to the fluid being reclaimed so that the adhesive bond is not broken down by the liquid. By use of spaced dots 67, such as spaced around the periphery of the filter, the adhesive does not need to be permeable to the liquid. Rather, filtration is achieved at non-bonded areas of the filter layer 61.

An alternative method of providing liner layer 66 would be through coating of the felt filter layer 61 using conventional coating techniques.

Liner layer 66 has a suitable thickness that allows the filter 61 to remain flexible, while having sufficient thickness to be durable against frictional contact with roller 20 for the life expectancy of the drum maintenance unit. An exemplary liner layer has a thickness of between 0.05 to 0.06 mm.

Liner 66 is preferably formed of polyester, experiences less shed, and has a lower coefficient of friction than felt filter layer 61. Additionally, the liner is composed of long fibers that are thermally bonded to one another to form a continuous web. To achieve permeability of the liquid through the liner, liner layer 66 has a predefined porosity. In preferred embodiments, the liner is a thermally bonded non-woven polyester that acts similar to a tea-bag, by allowing fluid transfer through the open area in between the thermally bonded fibers. By control of the open area, a defined degree of permeability can be attained to allow the filtered oil to pass through to the roller. An exemplary material is PET Type #227, available from BMP America Inc. Because the liner layer 66 has long bonded fibers, there is a reduction of material shed as a result of frictional contact with the roller 20.

Because at least the contact portions of the front face of filter 61 are covered by low friction liner 66, free rotation of roller 20 can be ensured, even when using a roller with a fairly high coefficient of friction. Also, because the felt filter 61 does not directly contact roller 20 and is thus no longer subjected to frictional forces, the loosely tangled felt filter layer 61 does not experience shedding of fibers. Moreover, the liner layer 66 does not shed fibers even when subjected to frictional forces because of a combination of its long fibers and thermal bonding. Because of this, the filter 61 can be expected to have an extended useful life, even when a high friction roller is used. The useful life of the cartridge 12 varies depending on the amount of oil loaded in the roller 20 and the type of cartridge. The useful life of a typical drum maintenance unit may be between 10,000 and 30,000 prints before replacement is necessary. The reduction of fiber shedding is important because fibers shed may be contaminants of the printhead. Therefore, eliminating fiber shed may improve the reliability of the printhead.

In a preferred embodiment, the lower liquid receiving portion 62 of the filter 61 is slightly shorter and flat (FIG. 8), compared to the relatively longer and jagged end of the prior design (FIG. 7). The prior design relied upon the extra material to fold onto itself to increase the filter thickness in this bottom region. However, in certain configurations, this may excessively increase the interference fit between the roller and filter, placing too much frictional force on the roller. However, by shortening and flattening the portion 62 and not folding it under, a desirable fit and friction may be obtained.

To alert an operator that the cartridge 12 should be replaced, a life status assembly (not shown) may be used to determine the end of the useful life of the cartridge. The life status assembly may be in the cartridge 12 or in another part of the imaging device. In embodiments, the life status is managed by an electronic EEPROM single wire device (SWD) located onboard the cartridge. The SWD, which contains a circuit board, is electrically connected to the printer 10 when the cartridge 12 is fully inserted in the printer and includes an internal counter that is decremented as prints are made. When the counter in the circuit board reaches a predetermined value that is calculated to correspond to a low oil condition in the oil-impregnated roller 20, the printer 10 generates a message on the display panel 11 (see FIG. 1) that advises the operator to replace the cartridge 12. The useful life of the cartridge 12 varies depending on the amount of oil loaded in the roller 20 and the type of cartridge. When a cartridge 12 is replaced, a new life status assembly may also be provided. The life status assembly may also store additional cartridge life status data and related information.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A system for applying a liquid to a support surface in an imaging apparatus and reclaiming part of the liquid, the system comprising:

a roller surface that applies liquid to the support surface;

a liquid permeable filter having a back filtration surface and a front filtration surface; and a low friction liquid permeable liner surface separate and distinct from the liquid permeable filter and interposing the roller surface and the liquid permeable filter, the liner surface being in direct frictional contact with the roller surface, the filter receiving liquid reclaimed from the support surface on the back filtration surface and passing clean liquid through the front filtration surface past the liner surface and to the roller surface.

2. The system of claim 1, wherein the roller surface is impregnated with the liquid and is in rolling contact with the support surface.

3. The system of claim 1, wherein the liner layer defines open areas between layer fibers that are permeable to the liquid.

4. The system of claim 1, wherein the filter is formed of a non-woven textile and the liner surface is a separate layer formed of long fibers that are thermally bonded into a continuous web to reduce shedding of fibers.

5. The system of claim 4, wherein the non-woven textile is a polyester felt.

6. The system of claim 4, wherein the non-woven textile is a polyester felt and the liner layer is a liquid permeable polyester.

7. The system of claim 6, wherein the polyester is a thermally bonded, non-woven polyester.

8. The system of claim 1, wherein the support surface is a surface of a transfer drum.

9. The system of claim 8, wherein the liquid is an oil.

10. The system of claim 1, further comprising a metering blade for distributing the liquid on the support surface, wherein the metering blade reclaims liquid from the support surface, which passes through the filter to the roller surface.

11. The system of claim 10, further comprising an elongated blade mounting bracket to which the blade is attached, the blade mounting bracket including downwardly directed drip points for communicating liquid reclaimed from the support surface to the filter.

12. The system of claim 1, further comprising a physical barrier that is impermeable to the liquid and located to block reclaimed liquid from coming in contact with the support surface of the imaging apparatus without passing from the back filtration surface of the filter through the front filtration surface and the liner surface, wherein the physical barrier provides structural support to the filter.

13. An imaging device comprising:

a support surface;

a roller surface that applies liquid to the support surface to form an intermediate liquid transfer surface on the support surface;

a liquid permeable filter having a back filtration surface and a front filtration surface;

a separate liquid permeable low friction liner surface interposing the roller surface and the front filtration surface, the liner surface being in direct frictional contact with the roller surface, the filter receiving liquid reclaimed from the support surface on the back filtration surface and passing clean liquid through the front filtration surface past the liner surface and to the roller surface; and a print head that applies ink onto the intermediate liquid transfer surface on the support surface.

14. The imaging device of claim 13, wherein the imaging device is a phase change, offset ink jet printer and the support surface is an intermediate transfer drum.

15. The imaging device of claim 13, wherein the liner is formed of long fibers that are thermally bonded into a continuous web to reduce shedding of fibers.

16. The imaging device of claim 13, further comprising:

a physical barrier that is impermeable to the liquid and located to block reclaimed liquid from coming in contact with the support surface of the imaging apparatus without passing from the back filtration surface of the filter through the front filtration surface and the liner surface, wherein the physical barrier provides structural support for the filter.

17. A method for applying a liquid to a support surface and reclaiming excess liquid in an imaging device, the method comprising:

bringing a roller surface into contact with the support surface to apply liquid from the roller surface to the support surface through rolling of the roller surface;

metering the liquid on the support surface, thereby reclaiming a portion of the liquid from the support surface;

passing liquid removed from the support surface through a low-friction permeable filter to the roller surface for reapplication of the liquid to the support surface, the filter including a back filtration surface and a front filtration surface, a low friction separate liner surface formed from thermally bonded long fibers interposing the roller surface and the front filtration surface, the liner surface being in direct frictional contact with the roller surface during rotation of the roller surface, the filter receiving liquid reclaimed from the support surface on the back filtration surface and passing clean liquid through the front filtration surface past the liner surface and to the roller surface.

18. The method of claim 17, further comprising:

blocking passage of the removed liquid from reapplication to the support surface without passing from the back filtration surface of the filter through the front filtration surface and the liner surface by positioning of a liquid impermeable physical barrier.

19. The method of claim 18, further comprising structurally supporting the filter using the physical barrier.

* * * * *